US008033128B2

(12) United States Patent
Giertz et al.

(10) Patent No.: US 8,033,128 B2
(45) Date of Patent: Oct. 11, 2011

(54) HEAT PUMP ASSEMBLY

(75) Inventors: Bjorn Giertz, Bromma (SE); Thomas Wildig, Sollentuna (SE)

(73) Assignee: Scandinavian Energy Efficiency Company SEEC AB, Saltsjo-Duvnas (SE)

( * ) Notice: Subject to any disclaimer, the term of this patent is extended or adjusted under 35 U.S.C. 154(b) by 0 days.

(21) Appl. No.: 12/518,550

(22) PCT Filed: Dec. 6, 2007

(86) PCT No.: PCT/SE2007/050944

§ 371 (c)(1),
(2), (4) Date: Nov. 4, 2009

(87) PCT Pub. No.: WO2008/073039

PCT Pub. Date: Jun. 19, 2008

(65) Prior Publication Data

US 2010/0064709 A1 Mar. 18, 2010

(30) Foreign Application Priority Data

Dec. 13, 2006 (SE) ..... 0602688-4

(51) Int. Cl.
*F25D 23/12* (2006.01)

(52) U.S. Cl. ..... 62/260; 62/324.1

(58) Field of Classification Search ..... 62/260, 62/160, 238.7, 325, 324.1, 324.6; 165/45, 165/61

See application file for complete search history.

(56) References Cited

U.S. PATENT DOCUMENTS

| | | | | | |
|---|---|---|---|---|---|
| 3,782,132 | A | * | 1/1974 | Lohoff | 62/260 |
| 3,965,694 | A | * | 6/1976 | Vignal et al. | 62/260 |
| 4,237,963 | A | * | 12/1980 | Girard | 165/45 |
| 4,257,239 | A | | 3/1981 | Partin et al. | |
| 4,327,560 | A | * | 5/1982 | Leon et al. | 62/260 |
| 4,392,531 | A | * | 7/1983 | Ippolito | 166/278 |
| 4,522,253 | A | * | 6/1985 | Levin | 165/207 |
| 4,718,248 | A | * | 1/1988 | Fisher | 62/238.7 |
| 5,038,580 | A | * | 8/1991 | Hart | 62/324.6 |
| 5,140,829 | A | * | 8/1992 | Barwacz | 62/260 |
| 5,388,419 | A | * | 2/1995 | Kaye | 62/160 |
| 5,461,876 | A | * | 10/1995 | Dressler | 62/160 |

(Continued)

FOREIGN PATENT DOCUMENTS

WO 90/02300 3/1990

OTHER PUBLICATIONS

International Search report dated Apr. 2, 2008, from corresponding PCT application.

*Primary Examiner* — Mohammad Ali
(74) *Attorney, Agent, or Firm* — Young & Thompson

(57) ABSTRACT

Heat pump assembly for seasonal balancing of temperatures in buildings, includes a heat pump (1) having a cold side and a warm side, respectively. The heat exchangers (2, 3) are connected to the cold and the warm side, respectively, in that one of the heat exchangers (3) is connected to a heating/cooling element (4), in that the other heat exchanger (2) is connected to a heat/cold buffer (6), in that the heat pump (1) is of the type liquid-liquid, and in that a valve assembly (7) is arranged in the heat pump (1) to optionally connect the warm or cold side of the heat pump (1) to the heating/cooling element (4), whereby the heating/cooling element (4) optionally may heat or cool.

9 Claims, 2 Drawing Sheets

Figure 1:
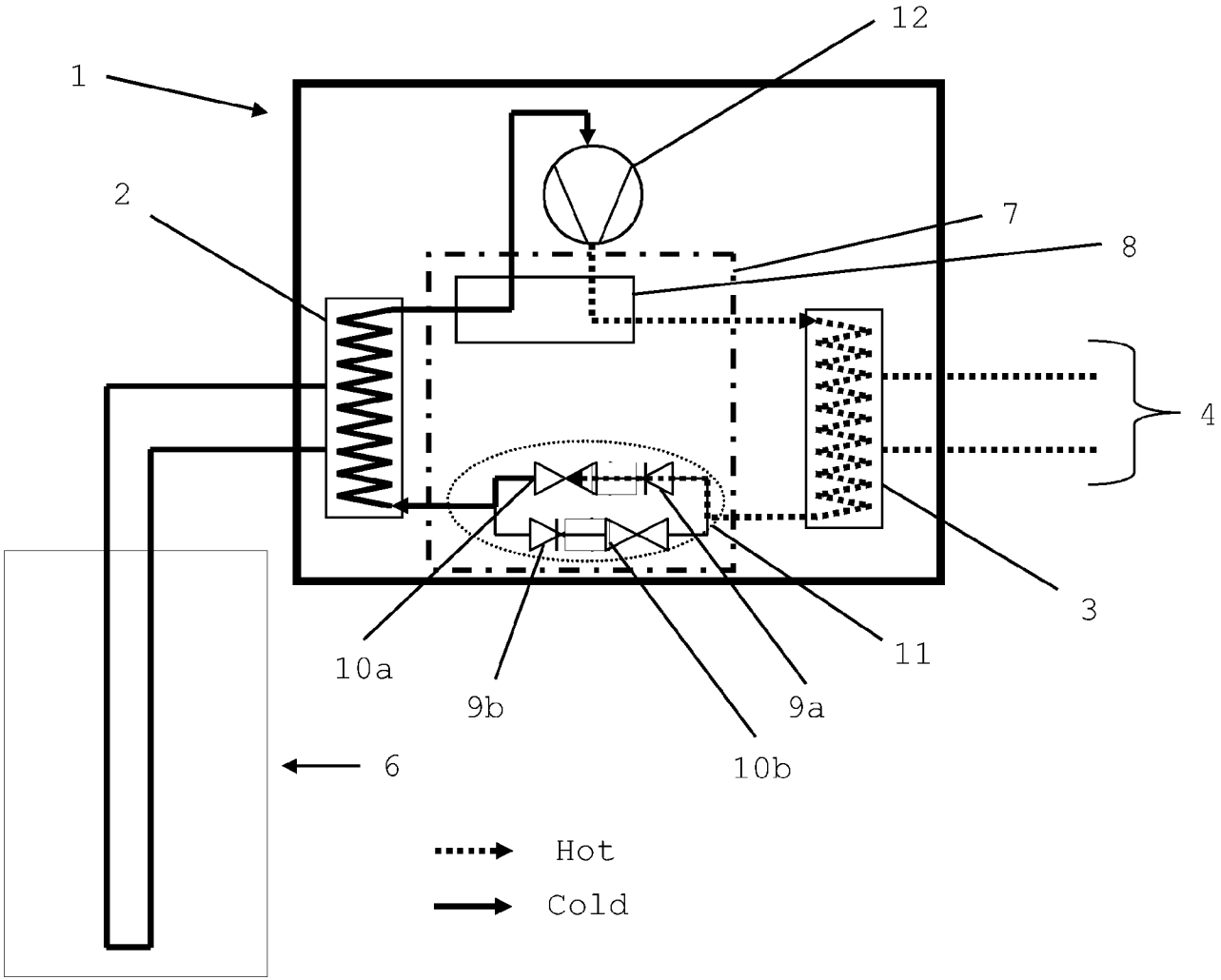

U.S. PATENT DOCUMENTS 5,533,355 A * 7/1996 Rawlings ..... 62/260
5,678,626 A * 10/1997 Gilles ..... 165/62
6,332,335 B1 * 12/2001 Kajimoto et al. ..... 62/434
6,405,551 B1 6/2002 Kuwabara et al.
6,427,453 B1 * 8/2002 Holtzapple et al. ..... 62/92
6,449,973 B2 * 9/2002 Dodge et al. ..... 62/240
6,536,677 B2 * 3/2003 Melendez-Gonzalez et al. ..... 237/2 B
6,615,601 B1 * 9/2003 Wiggs ..... 62/235.1
6,655,155 B2 * 12/2003 Bishop ..... 62/45.1
6,990,826 B1 * 1/2006 Lifson et al. ..... 62/324.1
7,032,398 B2 * 4/2006 Dilk et al. ..... 62/235
7,082,779 B2 * 8/2006 Xu ..... 62/260
7,124,597 B2 * 10/2006 Kattner et al. ..... 62/260
7,254,955 B2 * 8/2007 Otake et al. ..... 62/238.7
7,401,475 B2 * 7/2008 Hugenroth et al. ..... 62/467
7,681,410 B1 * 3/2010 Bean, Jr. ..... 62/259.2
2003/0042014 A1 * 3/2003 Jin ..... 165/240

* cited by examiner

HEAT PUMP ASSEMBLY

The present invention relates to a heat pump for cooling and heating for example a house, more precisely for cooling and heating of houses in climatic zones in which refrigeration of air is a major need in order to keep an agreeable indoor temperature.

Presently, heat pumps are used for heating houses. Certain heat pumps may also be used for cooling a house, whereby refrigeration is desirable in houses in a climatic zone in which it is warmer outdoors than what is pleasant indoors. In these cases, it will usually be warmer indoors than what is pleasant.

In climatic zones where cooling is required to obtain a comfortable indoor temperature, commonly an air/air heat pump is installed. The heat pump may also be used during that season of the year when it is colder outdoors than what is desirable indoors, for the production of heat.

There are problems associated with cooling using such heat pumps in climatic zones where there usually is a need for cooling. The ability of heat pumps of efficient cooling, in order to obtain a comfortable temperature indoors, is not sufficient. For example, houses may need a substantial cooling, which is something air/air heat pumps are not always capable of doing.

Also, in climatic zones where air usually more often needs cooling rather than heating, there is a risk that insulations and seals in the houses do not work satisfactorily, since insulations and seals of houses usually are associated with keeping out the cold and keeping a warm indoors climate. In warmer countries, houses are less tightly built and less insulated. Furthermore, few radiators are usually installed in the house in order to obtain agreeable warmth indoors during the winter. Therefore, electrical radiators are frequently positioned in the building during the periods when it is colder outside than inside, so that the indoor temperature is kept at a comfortably warm level. The radiators are set for producing an elevated temperature, and therefore they get hot. These electrical radiators heat the house locally, which is why it may at the same time be relatively cold at some places in the house that lack electrical radiators.

Heat production is associated with the fact that it is expensive to let radiators heat the house. However, it is associated with still higher cost to cool air which easily holds a too high temperature if the temperature outdoors is high. Foremost, it is expensive to achieve an indoor temperature which is comfortable when it is warmer outside than inside.

Thus, the purpose of the invention is to make it possible to use a heat pump which is reversible, in other words to be able to both cool and heat, and a heat pump which cools and heats cheaper than today.

The present invention solves these problems.

Hence, the present invention relates to a heat pump assembly for seasonal balancing of temperatures in buildings, comprising a heat pump having a cold side and a warm side, respectively, and is characterized in that heat exchangers are connected to said cold and said warm side, respectively, in that one of the heat exchangers is connected to a heating/cooling element, in that the other heat exchanger is connected to a heat/cold buffer, in that the heat pump is of the type liquid-liquid, and in that a valve assembly is arranged in the heat pump to optionally connect the warm or cold side of the heat pump to the heating/cooling element, whereby the heating/cooling element optionally may heat or cool.

Figure 2:
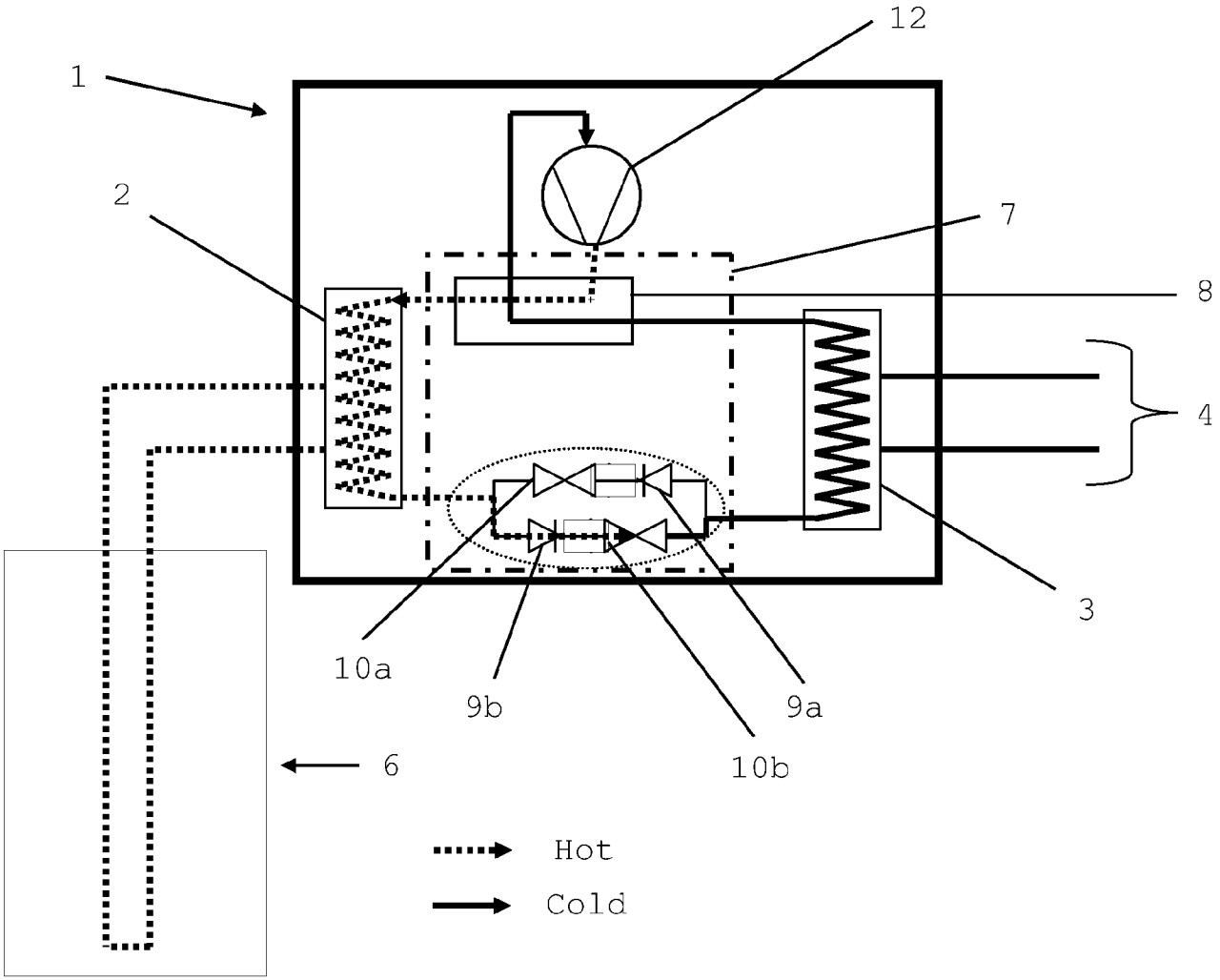

Below, the invention is described in closer detail, partly in connection with embodiments of the invention shown in the appended drawings, where FIG. 1 schematically shows how a heat pump 1 and heat exchangers 2, 3 are positioned in relation to a heat/cold buffer 6 and a heating/cooling element 4 during heat production;

FIG. 2 schematically shows how a heat pump 1 and heat exchangers 2, 3 are positioned in relation to a heat/cold buffer 6 and a heating/cooling element 4 during cooling;

Thus, the present invention relates to a heat pump assembly for seasonal balancing of the temperature in buildings, comprising a heat pump 1 with a cold side and a warm side, respectively.

FIGS. 1 and 2 show that, according to the invention, heat exchangers 2, 3 are connected to said cold and warm sides, respectively. One of the heat exchangers 3 is connected to a heating/cooling element 4, and the other heat exchanger 2 is connected to a heat/cold buffer 6. The heat pump 1 is of the type liquid-liquid. A valve assembly 7, shown in the figures as a box with dot dashed lines, is arranged in the heat pump 1 so as to optionally connect the warm or the cold side of the heat pump 1 to the heating/cooling element 4, whereby the heating/cooling element 4 optionally may deliver or absorb thermal energy to or from its surroundings.

For example, the heating/cooling element 4 is radiators, loops in the floor or fan coil units.

In both cases, FIGS. 1 and 2, the dotted lines denote the warm side and the solid lines denote the cold side.

According to a preferred embodiment, the valve assembly 7 comprises a 4-way valve 8, arranged so as to be adjustable for letting the liquid flow in an optional direction.

Depending on whether the heating/cooling element 4 should be connected to the warm or the cold side of the heat pump 1, the 4-way valve 8 is arranged to alter its setting. The 4-way valve may be arranged in any suitable manner in order to achieve these settings. One example is that an inner tube is positioned in an outer tube, where both tubes have holes at different locations in the wall of the respective tube. Depending on the direction in which the cooling medium in the 4-way valve 8 should flow, one of the outer and the inner tube may be rotated so that a new set of holes through the inner and outer tube will appear. Thereby, the cooling medium is forced to flow in one chosen direction.

According to a preferred embodiment, the valve assembly 7 is also arranged with an expansion unit 11, see the dotted ellipse in FIGS. 1 and 2, comprising an expansion valve 10*a*, 10*b*, positioned downstream of a non return valve 9*a*, 9*b*. According to yet another preferred embodiment, two sets of a non return valve 9*a*, 9*b* and an expansion valve 10*a*, 10*b* are arranged in opposite directions in the expansion unit 11, whereby warm fluid optionally may flow from each of the heat exchangers 2, 3. However, the non return valve 9*a*, 9*b* in both sets of a non return valve 9*a*, 9*b* and an expansion valve 10*a*, 10*b*, forces the cooling medium to flow in a particular direction. Since the expansion unit 11 is equipped with two oppositely directed sets of a non return valve 9*a*, 9*b* and an expansion valve 10*a*, 10*b*, the cooling medium is forced to flow only in one direction in each respective set of a non return valve 9*a*, 9*b* and an expansion valve 10*a*, 1*b*.

Since a heat pump 1 is equipped with a compressor 12, arranged to raise the temperature of the cooling medium, and an expansion valve, arranged to lower the temperature of the cooling medium, the valve assembly 7 is essential for making it possible to use the compressor 12 and the expansion valves of the heat pump independently of whether what is desired to bring to the heating/cooling element 4 is heating or cooling, and also to let the heat exchangers 2, 3 be arranged in the same manner in relation to each other and to the valve assembly 7, regardless of at what side of the heat pump 1 the cold or the warm side is currently located.

According to another preferred embodiment, the heat/cold buffer 6 comprises at least one hole in the ground, in which a heating/cooling medium is circulated in a closed loop. The heating/cooling medium is a liquid of a suitable, known kind, for example water or a liquid with an anti-freeze agent, for lowering the freezing point of the liquid.

As is shown in FIGS. 1 and 2, three loops are arranged in the heat pump assembly. A first loop, the closed loop at the heat/cold buffer 6, is arranged to be carried through the first heat exchanger 2. The second closed loop is arranged in the heat pump 1, away from the heat exchanger 2, in other words at the other side of the first loop, through the valve assembly 7 and further to the heat exchanger 3. A third, closed loop is arranged from the heat exchanger 3, on the other side of the second loop, out to the heating/cooling element 4 and back to the heat exchanger 3.

According to yet another embodiment, the heat/cold buffer 6 is arranged to receive and emit, respectively, thermal energy from and to a bore hole in the ground. To this end, the heat/cold buffer 6 is constituted by the ground. Instead, the heat/cold buffer 6 may for example be constituted by sea water or collectors in the ground.

According to one mode of operation, the valve assembly 7 is arranged so that the warm side of the heat pump 1 is connected to the second heat exchanger 3, whereby a production of heat is achieved, see FIG. 1.

During heat production, the liquid in the conduits of the first loop reaches a certain temperature after having flown down into and up from the ground. As the liquid flows on, by the aid of a pump (not shown), into the heat exchanger 2, the liquid is heat exchanged against the cooling medium in the second loop. Thereafter, the liquid in the first loop, now a few degrees colder, flows on, down into the bore hole again, in which the liquid is heated, since the temperature in the bore hole is higher than the temperature of the liquid that has just passed the heat exchanger 2.

The cooling medium in the second loop is heated several degrees by heat exchange against the liquid in the first loop in the heat exchanger 2. After passage through the heat exchanger 2, the cooling medium in the second loop flows on through the 4-way valve 8, which is set in a mode allowing the cooling medium to flow to the compressor 12. There, the cooling medium is heated as a consequence of an increased pressure, and the cooling medium is thereafter led into the 4-way valve 8 once more, after which it flows on to the heat exchanger 3. The cooling medium in the second loop is heat exchanged against the liquid in the third loop, whereby the temperature of the cooling medium in the second loop after passage of the heat exchanger 3 falls. Thereafter, the cooling medium in the second loop flows on into the expansion unit 11, at which the liquid may only flow through the non return valve 9*a*. In the expansion valve 10*a*, the temperature of the cooling medium is lowered considerably due to a pressure drop, and the cooling medium thereafter again finds itself back at the heat exchanger 2.

The liquid in the third loop is heat exchanged in the heat exchanger 3 to higher temperature than before, as described above. Thus, a pump, positioned in the third loop, may pump the liquid to the radiators 4, that thereby emit heat. As the liquid flows back to the heat exchanger 3, the temperature of the liquid has fallen somewhat. Thereafter, the liquid flows back into the heat exchanger 3, whereby the temperature of the liquid is again raised.

The heat exchangers 2, 3 are standard, and both the heat exchangers 2, 3 are preferably arranged with the same performance characteristics, since both heating and cooling will be performed by both the heat exchangers 2, 3. The number of degrees that the heat exchangers 2, 3 heat exchange up or down during heating and cooling, respectively, lies within an interval so that the heat exchangers 2, 3 may be of the same type, which is preferred.

The liquid in the loops may flow with various velocities, through the heat exchangers 2, 3, so as to obtain a desired temperature drop or rise of the liquid, as compared to before and after passage through the heat exchangers 2, 3.

According to another mode of operation, the valve assembly 7 is arranged so that the cold side of the heat pump 1 is connected to the second heat exchanger 3, whereby cooling is achieved.

In this case, during cooling, see FIG. 2, liquid in the first loop is circulated by pumping action so as to be heat exchanged to higher temperature in the heat exchanger 2. Thus, the cooling medium is heat exchanged to lower temperature in the second loop. The cooling medium in the second loop flows in the opposite direction in the heat exchangers 2, 3 and the valve assembly 7 as compared to during heating. After the cooling medium in the second loop has flown through the heat exchanger 2, the cooling medium flows through the expansion unit 11, however through the opposite set of a non return valve 9*b* and an expansion valve 10*b* as compared to during heating. The cooling medium, which thereafter flows through the heat exchanger 3, is heat exchanged to higher temperature and flows on into the 4-way valve 8, which is set in another mode as compared to during heating. Thereafter, the cooling medium flows on into the compressor 12, where liquid is heated further as a consequence of a pressure rise. From here, the cooling medium flows through the 4-way valve again, and on to the heat exchanger 2.

The third loop is heat exchanged to lower temperature in the heat exchanger 3, so as to obtain a temperature at which fan coil units 4 may cool the surrounding air.

In countries where the ground keeps a temperature several degrees below the indoor temperature, a heat pump is not to required. In this case, coldness from the ground could be taken directly for cooling the air indoors. However, there are climatic zones with elevated ground temperature, why no refrigeration would be achieved if the temperature of the liquid, flowing through the bore hole, should be used without a heat pump. Therefore, the present invention has its main area of use in climatic zones with high ground temperatures during the summer, for example in southern Europe, such as in Spain and Italy, in Africa or in other geographical areas around the world with a similar climate throughout the year.

According to yet another example, the heat pump assembly may be used for production of heated or chilled water. In this example, a water heater is connected to the heat pump 1, and hence to the heat exchanger 3. Otherwise, the production of hot and cold water, respectively, to the water heater functions in the same way as the heating and cooling of the heating/cooling element 4.

Above, a number of embodiments and applications have been described. However, the valve assembly 7, and the heat pump 1, the heat exchangers 2, 3 and the heat/cold buffer 6 may be designed in other suitable ways without departing from the basic idea of the invention.

Thus, the present invention is not limited to the above indicated method embodiments, but may be varied within the scope of the appended claims.

The invention claimed is:

1. Heat pump assembly for seasonal balancing of temperatures in buildings, comprising:

a heat pump (1) having a cold side and a warm side, respectively; and heat exchangers (2, 3) connected to said cold and said warm side, respectively, wherein one of the heat exchangers (3) is connected to a heating/cooling element (4), and wherein the other heat exchanger (2) is connected to a heat/cold buffer (6), arranged to receive and emit, respectively, thermal energy from and to the ground or from sea water, wherein a valve assembly (7) is arranged in the heat pump (1) to connect the warm or cold side of the heat pump (1) to the heating/cooling element (4), whereby the heating/cooling element (4) heat or cool, wherein the heat pump (1) is of the type liquid-liquid, and wherein said heat pump comprises three closed loops for liquid, the three closed loops including i) a first loop connected to the heat/cold buffer and the first heat exchanger, ii) a second loop arranged in the heat pump, connected to both heat exchangers, and iii) a third loop connected to the second heat exchanger and to the heating/cooling element, during operation, thermal energy is transferred, via the heat pump, i) in a first configuration, from the liquid in the first loop to the liquid in the third loop and ii) in a second configuration, from the liquid in the third loop to the liquid in the first loop.

2. Heat pump assembly according to claim 1, wherein the valve assembly (7) comprises a 4-way valve (8), arranged to be adjusted so that the heating/cooling element (4) constitute the warm or the cold side, respectively.

3. Heat pump assembly according to claim 1, wherein the valve assembly (7) is arranged with an expansion unit (11), comprising an expansion valve (10*a*, 10*b*) positioned downstream of a non return valve (9*a*, 9*b*).

4. Heat pump assembly according to claim 3, wherein two sets of a non return valve (9*a*, 9*b*) and an expansion valve (10*a*, 10*b*) are arranged in opposite directions to each other in the expansion unit (11), whereby warm liquid flow from one of the two heat exchangers (2, 3).

5. Heat pump assembly according to claim 1, wherein the heat/cold buffer (6) comprises at least one hole in the ground, in which a heating/cooling medium is circulated in a closed loop.

6. Heat pump assembly according to claim 1, wherein the heat/cold buffer (6) is arranged to receive heating or cooling, respectively, from a bore hole in the ground.

7. Heat pump assembly according to claim 1, wherein both the heat exchangers (2, 3) are arranged with the same performance characteristics.

8. Heat pump assembly according to claim 2, wherein the valve assembly (7) is arranged with an expansion unit (11), comprising an expansion valve (10*a*, 10*b*) positioned downstream of a non return valve (9*a*, 9*b*).

9. Heat pump assembly according to claim 8, wherein two sets of a non return valve (9*a*, 9*b*) and an expansion valve (10*a*, 10*b*) are arranged in opposite directions to each other in the expansion unit (11), whereby warm liquid may flow from one of the two heat exchangers (2, 3).

* * * * *